United States Patent [19]

Channel et al.

[11] Patent Number: 4,607,310

[45] Date of Patent: Aug. 19, 1986

[54] ADJUSTABLE DEGAUSSER

[75] Inventors: William D. Channel; Charlie E. Gunter, III, both of Oklahoma City, Okla.

[73] Assignee: Magnetic Peripherals Inc., Minneapolis, Minn.

[21] Appl. No.: 733,565

[22] Filed: May 13, 1985

[51] Int. Cl.[4] ..... H01F 13/00

[52] U.S. Cl. ..... 361/149

[58] Field of Search ..... 361/145, 149, 150, 151, 361/267

[56] References Cited

U.S. PATENT DOCUMENTS 4,462,059 7/1984 Yamagami et al. ..... 361/149

*Primary Examiner*—Michael L. Gellner

*Attorney, Agent, or Firm*—J. A. Genovese; M. B. Atlass

[57] ABSTRACT

This invention relates to the field of degaussing devices and has particular applicability to such devices which are used to remove magnetic bias from digital recording heads in mass storage devices. It provides for a device which employs a microcontroller integrated circuit capable of hardware multiply and a digital to analog converter to produce a decaying sinewave signal. The rest of the general requirements for a functional degauss circuit are generally shown. The height and frequency of this sinewave signal can be modified under software control using this invention.

11 Claims, 6 Drawing Figures

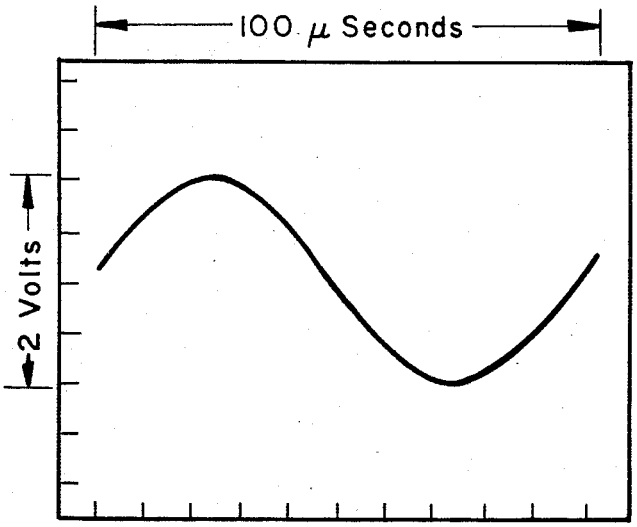
Signal seen at
Fig. 1, line 51, Fig. 2, line 151
FIG. 2a
FIG. 2b
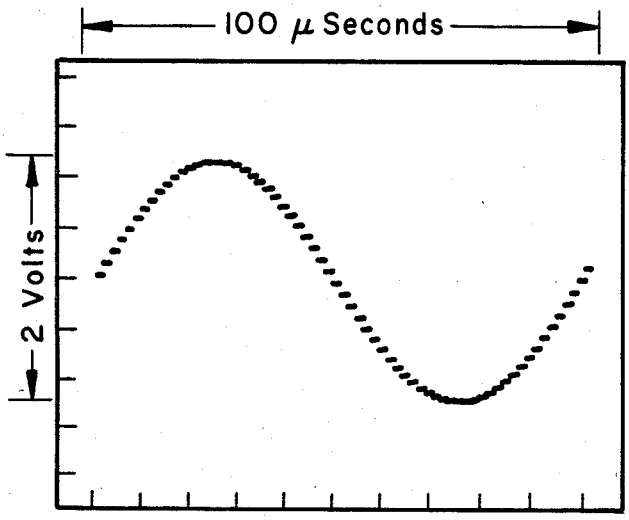
Signal seen at
Fig. 1, line 31, Fig. 3, line 131
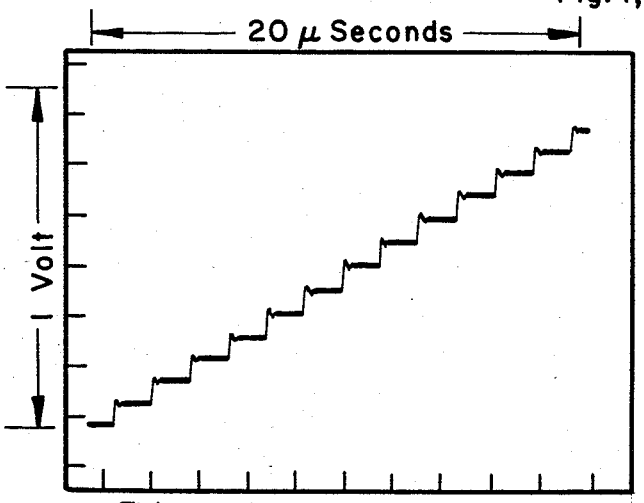
Enhanced portion of signal at
Fig. 1, line 31, Fig. 3, line 131
FIG. 2c

ADJUSTABLE DEGAUSSER

FIELD OF THE INVENTION

This invention relates to the field of degaussing or removing the magnetic bias from workpieces that are magnetizable. More particularly it relates to such devices which are designed to degauss magnetic read/-write heads which heads are used in data or other recording on magnetic media.

BACKGROUND OF THE INVENTION

During use, assembly, or due to changes in the ambient magnetic field, magnetizable pieces of matter may pick up a magnetic bias. Where this occurs in the read/-write heads in magnetic recording systems, and particularly in high density data systems, there are several effects which may be deleterious to the performance of the system. One problem is that the recording characteristics of the head deteriorate when the head has magnetic bias. Another problem is that a head used to follow high density data tracks may be forced by the bias to follow to one side or the other of a data track thus risking reading failure or misplaced writings.

Degaussing is a practice which is well known. The process in one form consists of exposing the workpiece to an alternating magnetic field of decreasing intensity. Another degaussing process would be to direct an exponentially decaying alternating current signal through the windings of the read/write head itself. This second method however, requires rigid frequency and current limits in order to protect the head windings from unwanted damage.

Also, due to environmental influences on the degaussing signal generating components themselves, a D.C. offset in the degauss signal will often result. If this bias is not corrected the "Degausser" will bias the head.

The invention herein overcomes these difficulties and provides the degausser with the ability to change the voltage, frequency, and decay paramaters so that a range of workpieces or magnetic read/write heads may be degaussed without changing the circuit components, rather by merely changing the software. No other known degaussing device can do this.

SUMMARY OF THE INVENTION

Basicly, this invention provides for a degausser which generates a sinewave which decays over time and which can vary the amplitude of that sinewave used in degaussing, the sinewave frequency, and its exponential decay rate, and it can vary these under software control, without changing any components. It also corrects for D.C. offset in the degauss signal which would otherwise provide its own magnetic bias to the probe or workpiece.

Although the invention is not limited to the particular form described with reference to FIG. 1 (as should be clear to those in the art) it can be generally described as comprising the following elements.

A microcontroller circuit 20 is used to generate a series of binary values which are converted by a digital to analog converter circuit (DAC) 30 to a sinusoidal voltage comprises of a fixed number of uniform voltage increments or steps per sinewave cycle (This staircase sinewave is later "smoothed" by a filter). The number of steps, the length of duration of the steps (and thus the slope of the sinewave), and the amplitude of the drop from one step to the next (and thus the sinewave amplitude), may be determined by the software controlling microcontroller circuit 20, whose signals control the output of the digital to analog converter circuit 30. This sinusoidal voltage is added to a D.C. offset correcting circuit 40 to yield a zero volt value for the centerline of the sinewave signal. (This signal correction is necessitated because of limitations in the available circuitry, to wit; a Digital to Analog Converter circuit must operate on an input of some non-negative value.) This corrected signal is processed through a filter 50 to eliminate noise and smooth the sine wave and then it goes to a current amplifier 60. The amplified output is sent to the workpiece (head) via a probe. The amplified output is also forwarded to an offset detector 70 which will pick up and forward information about any D.C. offset in the sinewave signal to the microcontroller circuit 20 which will adjust its output to this information. This adjustment is under software control. Continuity checking circuit 90 senses when the probe has lost contact with the head and passes this information to the microcontroller circuit 20, which may then alert alarm circuit 80 to generate an alarm.

Figure 1:
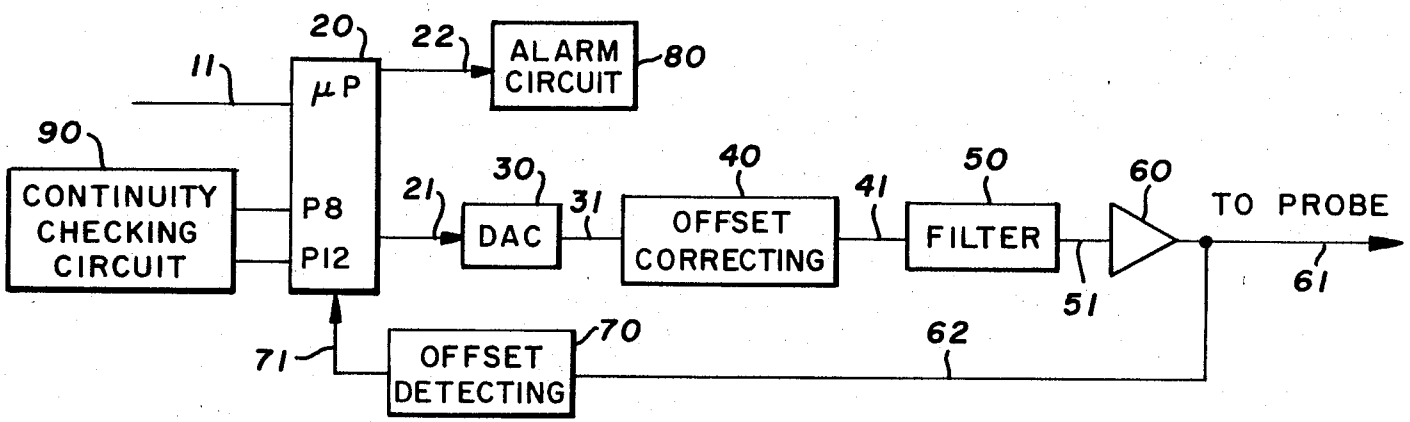
FIG. 1 is a block diagram of the preferred form of the invention.
Figure 3:
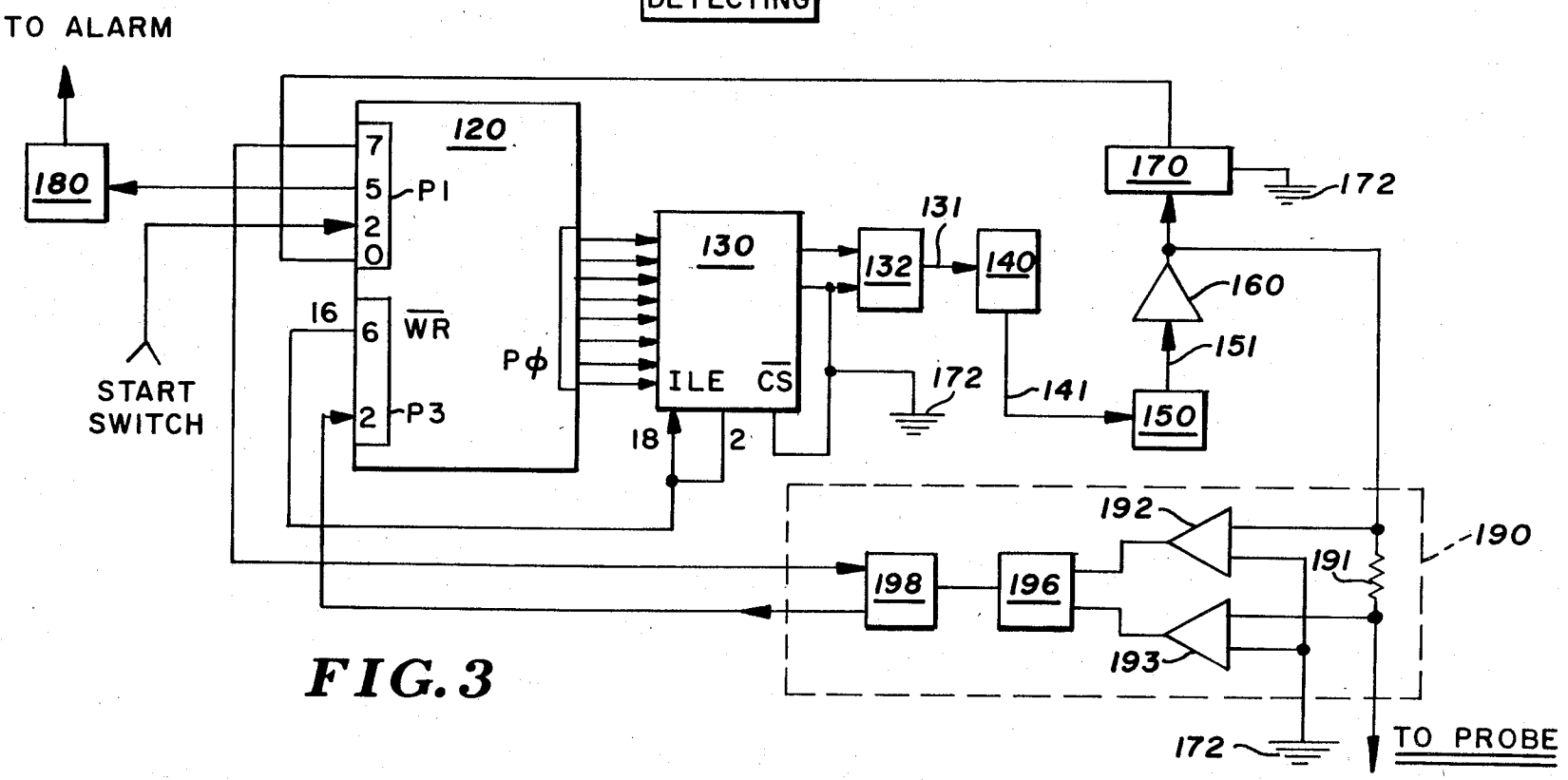

FIGS. *2a*, *2b* and *2c* are graphs of a portion of an exponentially decaying sinewave degauss signal generatable by this invention, through an oscilliscope lead being attached to the points of FIGS. 1 and 3 indicated thereon.

FIG. 3 is a circuit diagram of the preferred embodiment of the invention.

Figure 4:
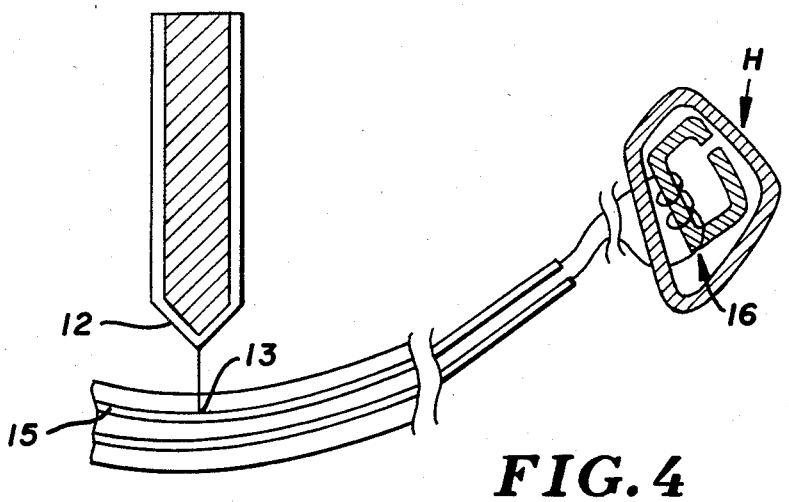

FIG. 4 is a composite which depicts one manner for connecting the output of the invention to a workpiece.

DETAILED DESCRIPTION OF THE INVENTION

This detailed description of the preferred embodiment is provided to describe the best mode for practicing this invention only and not to be construed to limit the scope of the invention to this mode of practicing it. Rather it is to illustrate the inventive concepts in a "concrete" embodiment.

Referring first to FIG. 3, wherein the preferred embodiment is generally referred to with the numeral 100, the microcontroller depicted is an Intel 8751H, produced by Intel Corp. of Santa Clara, Calif. which serves as microcontroller circuit 120. This particular chip is employed for its parallel output lines, which provide for fast and matching inputs to the Digital to Analog Converter (DAC) 130, and for its ability to perform hardware multiply instructions. Without this ability, no microprocessor could perform the calculations necessary to generate the sinewave voltage levels used in degaussing within the limited time available. Microcontroller circuit 120 is loaded with a software routine which resets an initiation switch 111 and waits for said switch to be thrown, whereupon it will run another subroutine to find the D.C. offset correction factor required by the circuit 100 so that the bias of the resultant sinewave degauss signal will be eliminated.

The routine used to find this D.C. offset correction factor first sends a signal over Port O, (designated as lines P0.0 through P0.7, or pins 32–39 as shown) which represents a voltage value higher than the normal zero value, say 200 mv. (The actual value used is not to be so high that it may burn out the head windings of the workpiece head, nor so low that it is under the potential value of the offset. The incremental voltage value addressable by the DAC used with this embodiment is 40 mv, which means that it can produce a shift up or down in voltage of 40 mv in response to a change in the smallest bit value across the eight input lines [which correspond to P0–P7]) In the next step, the DAC 130 will generate the analog voltage value which corresponds to the input signal, with op-amp 132 making the differential to single line conversion. Because the output of the digital to analog circuitry on line 131 is shifted 5 volts above zero, op-amp 140 is introduced into the circuit 100 to re-center the sinewave output on zero volts. (In this embodiment the DAC 130 is a National Semiconductor Corporation DAC chip called the 0830.)

A filter (in this embodiment it is the AF 100 -2CJ, another National Semiconductor product is employed, but others could substitute as is well understood in the art) 150 is the next element in the circuit 100. This is added to smooth out the staircase-step shape of the sinewave which results from the incremental nature of the output of the DAC 130 in this circuit. See FIG. 2*a;* representing the smoothed wave which would appear on an oscilliscope screen attached to the preferred embodiment at line 51 of FIG. 1 or line 151 of FIG. 3 and compare it to FIG. 2*b;* the signal produced by the DAC and seen at line 31 of FIG. 1 or line 131 of FIG. 3 [this FIG. 2*b* signal is the same signal, unshifted, which would also be seen at lines 41 and 141 of FIGS. 1 and 3, respectively].

The signal on line 151 is then current amplified by amplification circuit 160, and this amplified sinewave signal is the degaussing signal sent to a probe (probe 12 of FIG. 4) which makes electrical contact 13 with the head windings of the workpiece head(s) H, by means of a wire lead (like 15 of FIG. 4) which may be on the surface of a structure like the flexcable 14 which is shown. Any other method for connecting the output sinewave degauss signal to a coil around a workpiece could be employed, but the illustration in FIG. 4 is given because it is expected that the accurracy in signal production produced by this invention will be most applicable to the magnetic heads which are used in high density magnetic storage devices.

The signal on line 151 is available as positive input 173 to op-amp 170. The negative input 174 to op-amp 170 is from the system or reference ground 172. Op-amp 170, configured thusly, provides a "hi" signal to P1.0 of the 8751 microcontroller 120, for any time that the voltage on input 173, exceeds (by a certain minimum) that of the reference ground 172. When these two voltage values are equal, the microcontroller 120 (under the D.C. offset subroutine mentioned above) will store the value it has output to get that "hi" as the value it must send on lines P0.0 to P0.7 in order to introduce a zero voltage output from the DAC 130.

P3.2 and P1.7 of the 8751 microcontroller 120, provide input to and output from the continuity checking circuit 190. There are no doubt other arrangements which could work equally well to provide an indicator for response to loss of continuity, but this is the arrangement provided for by the preferred embodiment herein. This preferred embodiment uses a 9602 integrated circuit manufactured by National Semiconductor, which is set up to be retriggerable, with an output pulsewidth of 1.5 times the width of the degaussing sinewave. Since the occurrance of a loss of continuity would yeild an open circuit from line 175 to the probe or probe equivalent, the voltage on each side of the resistor 191 will be equal. This will cause a like signal to be generated by op-amps 194 and 195, thus signalling the sensing circuit 196 to stop its continous square wave retriggering output to the 9602 chip. Thus the output of the 9602 falls to zero whenever a sinewave peak is missing when it needs to be retriggered, thereby "alerting" the 8751 microcontroller 120. The microcontroller 120 will then shut down production of the sinewave and provide a signal on its output line P1.5 to initiate an appropriate alarm circuit 180 and associated alarm(not shown). It is to be noted that the Port and line numbers (as for example P1.5, above) are given for illustrative purposes only and that with different integrated circuit packages or even with different programs loaded into the same 8751 in the circuit as illustrated, different numbers may obviously be appropriate.

Refer now to FIG. 2. Notice that the sinewave generated at line 131 (or 31 with reference to FIG. 1) is in the form of a rising and falling staircase. The length of the horizontal portions of the stair (step) are determined by the length of time the DAC 130 is "clocked" by the microcontroller 120, before it determines that it is ready to have the DAC 130 receive the next signal from its lines P1.0 to P1.7. This is controlled by pin 16 (WR) and the value may be set by the 8751's software. This works in this circuit because the DAC 130 reads the bus (P1.0 to P1.7) each time a positive to negative transition occurs on the WR lines (pins 2 and 8). CS (pin 1 of the DAC 130) must be low and ILE (pin19) must be high during the "clocking" transition. The DAC puts out a DC level which corresponds to the binary value that it received during the clocking transition. The DAC will hold that value at its ouput until a new clocking transition is received, allowing it to receive the next binary value on the bus and generate a new corresponding DC level in response. Because the horizontal step lengths are equivalent to the length of time between clocking transitions, the overall frequency of the sinewave is determined by the length of this clocking type transition. Again, the "clocking" transitions are determined by software commands in the microcontroller circuit 120 which commands change the "clock" width (leading edge to leading edge interval) sent to pins 2 and 18 of the DAC 130. When the length of the step is lengthened, the time to run each cycle of the sinewave is increased, and vice-versa.

The size of the potential difference between each step and thus the height or amplitude of the sinewave may also be readily changed by software within the microcontroller 8751 120, and thus the height of the sinewave may be varied. The sinewave is generated by reference to a set of value points, each representing an equal incremental division of $2\pi$ radians. In the preferred embodiment 64 value points are used, 32 on the positive side of the sinewave and 32 on the negative. Even with an electronic set up identical to that illustrated for the preferred embodiment, the number of points may be varied under software control, since they only exist in a table resident, in the memory of the 8751 microcontroller 120. Where the number of points remains constant, changing the size of the increment between each step changes the overall height of the wave. Thus, instead of an output from lines P0.0 to P0.7 being incrementally increased by a single binary one (yeilding a 40 mv change in height) at each "clocking" of the DAC, a jump of binary two or more would result in an incremental change of 80 or more millivolts, therefore yeilding an overall steeper grade or slope for a constant step length, and taller overall height for a constant number of points.

Thus, by varying the software of a controller chip having hardware multiply capabilities, this invention can produce numerous accurate variations in the degauss sine wave and so be responsive to variable degaussing requirements and environments.

What is claimed is:

1. A degausser for use in cancelling the magnetic bias of a magnetizable workpiece by applying a decaying sinewave signal current of voltage appropriate to said workpiece, wherein said degausser comprises:

a start switch means for initiating said degaussing signal;

a microcontroller circuit, in electrical connection to said start switch means, containing memory registers capable of retaining instructions and data in the form of programs and subroutines, capable of multiplying binary values in its internal circuitry, having some number of output means for generating output signals and some number of input means (at least one of which is an offset indicating input means) for receiving input signals, and capable of generating on some of said output means a series of binary values the linear plot of which is a sinewave, and capable of centering said series of binary values about an offset value, responsive to a signal received by said microcontroller circuit on said offset indicating input means and wherein said microcontroller circuit may begin operation upon receiving a signal from said start switch means as an input signal on one of said input means;

a digital to analog conversion circuit having digital input means in electrical connection to some number of said microcontroller circuit output means, having analog output means and being capable of translating a digital signal input to said digital to analog conversion circuit on at least one of said digital input means to a predetermined voltage level output current which is output on said analog output means;

a current amplification circuit for increasing the absolute value of said analog output with its signal input being in electrical connection to said digital to analog output means, and having a signal output means for output of said amplified signal;

a system ground;

an offset detecting circuit having one input in electrical connection with said system ground, having a second input in electrical connection with said amplification circuit signal output means, and having an output in electrical connection with said microcontroller circuit (via said offset indicating input means), for generating an offset indicating signal upon detection by said offset detecting circuit of a potential difference between said system ground and said amplified output signal.

2. A degausser as set forth in claim 1 wherein said degausser further comprises a limited bandwidth filter circuit electrically connected to the output of said conversion circuit as input and to said amplifier circuit as its output.

3. A degausser as set forth in claim 1 wherein one of said microcontroller circuit outputs is variable with respect to its time of duration under control of said instructions, and wherein this one of said outputs operates as the clocking input for said digital to analog conversion circuit for controlling the length of time during which an analog signal output will appear from said analog conversion circuit.

4. A degausser as set forth in claim 3 wherein said degausser further comprises a conversion circuit electrically connected to the output of said digital to analog conversion circuit as its input, and with an output electrically connected to the input of said amplification circuit, for shifting said analog output signal a fixed number of volts.

5. A degausser as set forth in claim 4 wherein said degausser further comprises a limited bandwidth filter circuit electrically connected to the output of said conversion circuit as input and to said amplifier circuit as its output.

6. A degausser as set forth in claim 1 wherein said degausser further comprises a limited bandwidth filter circuit electrically connected to the analog signal output of said digital to analog conversion circuit as input and to said amplifier circuit as its output.

7. A degausser as set forth in claim 3 wherein said degausser further comprises a limited bandwidth filter circuit electrically connected to the analog signal output of said digital to analog conversion circuit as input and to said amplifier circuit as its output.

8. A degausser as set forth in claim 5 wherein said degausser further comprises a continuity checking circuit in electrical connection to both an input to said microcontroller circuit and to an output of said microcontroller circuit for detecting the occurrance of loss in continuity of the application of the signal to the workpiece, and upon such occurrance, for generation of a signal to said microcontroller circuit indicative of such event.

9. A degausser as set forth in claim 2 wherein said degausser further comprises a continuity checking circuit in electrical connection to both an input to said microcontroller circuit and to an output of said microcontroller circuit for detecting the occurrance of loss in continuity of the application of the signal to the workpiece, and upon such occurrance, for generation of a signal to said microcontroller circuit indicative of such event.

10. A degausser as set forth in claim 8 wherein said microcontroller has an output for initiating an alarm signal and wherein said degausser further comprises an alarm circuit for responding to said alarm signal.

11. A degausser as set forth in claim 9 wherein said microcontroller has an output for initiating an alarm signal and wherein said degausser further comprises an alarm circuit for responding to said alarm signal.

* * * * *